US008085944B2

(12) United States Patent
Kassner

(10) Patent No.: US 8,085,944 B2
(45) Date of Patent: Dec. 27, 2011

(54) DEVICE AND METHOD FOR ACTIVE NOISE CANCELLATION IN AN EXHAUST GAS CHANNEL OF A COMBUSTION ENGINE

(75) Inventor: Uwe Kassner, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 449 days.

(21) Appl. No.: 12/423,514

(22) Filed: Apr. 14, 2009

(65) Prior Publication Data

US 2009/0260916 A1 Oct. 22, 2009

(30) Foreign Application Priority Data

Apr. 16, 2008 (EP) ..... 08103557

(51) Int. Cl.
*H03B 29/00* (2006.01)

(52) U.S. Cl. ..... 381/71.14; 181/206

(58) Field of Classification Search ..... 381/71.1, 381/71.14, 71.7, 71.11; 181/206; 702/183
See application file for complete search history.

(56) References Cited

U.S. PATENT DOCUMENTS 5,222,148 A 6/1993 Yuan
5,325,438 A 6/1994 Browning et al.
5,410,606 A * 4/1995 Imai et al. ..... 381/71.14
5,692,052 A 11/1997 Tanaka et al.
6,944,303 B2 * 9/2005 Akiho ..... 381/71.14
2007/0297619 A1 * 12/2007 Pan ..... 381/71.11

FOREIGN PATENT DOCUMENTS

EP 0 0592 693 4/1994
EP 0 840 285 5/1998

* cited by examiner

*Primary Examiner* — Henry Choe
(74) *Attorney, Agent, or Firm* — Merchant & Gould P.C.

(57) ABSTRACT

The invention relates to an active noise cancellation device. The invention proposes a device and a method used to cancel the noise in an exhaust gas channel of a vehicle A noise signal is received form the exhaust gas channel, using a sound sensor, a frequency signal which has same amplitude as of noise signal but opposite phase, is generated, the generated frequency signal is acoustically mixed with the noise signal in the exhaust gas channel, using a sound converter, there by reducing the noise in the exhaust gas channel. The device also takes into account the reflection of the sound caused by an obstacle near the exhaust gas channel. A distance measuring device which is external to the active noise cancellation device provides the information about the distance between the obstacle and the exhaust gas channel. Based on the distance, the frequency signal is suitably modified to reduce the effect of sound reflections caused by the obstacle.

9 Claims, 2 Drawing Sheets

DEVICE AND METHOD FOR ACTIVE NOISE CANCELLATION IN AN EXHAUST GAS CHANNEL OF A COMBUSTION ENGINE

STATE OF THE ART

The invention relates to the field of active noise cancellation in an exhaust gas channel of a combustion engine. The patent EP 0 840 285 already discusses a device for active noise cancellation, with means to receive a sound signal from the exhaust gas channel, means to generate an anti noise signal, which, when acoustically coupled to the sound from exhaust gas channel, the result will be cancellation of both signals, resulting in reduction in noise.

ADVANTAGES OF THE INVENTION

The invention with the features of the independent claims has the following advantages:

The invention provides a device and a method to reduce the noise in the exhaust gas channel of a combustion engine, taking into account also the sound reflections caused by an obstacle located near the exhaust gas channel opening. This will result in comfort for the driver especially when the car is being parked and the exhaust gas channel may be near to a wall or near to another vehicle.

Further improvements and/or advantages are realised by the features of the dependent patent claims.

The major frequency component of the noise in the exhaust gas channel is estimated based on the engine speed. This involves only a simple but efficient computation.

As the pre stored data records are used to compute the dynamic part of the noise compensation, the control logic becomes simple and more efficient.

The relationship between the anti noise signal and the distance between an obstacle and the exhaust gas channel is available as pre stored data record, simplifying the computations at run time.

Also as the pre stored data records are created off line during application phase of the engine, large and accurate data can be stored.

SHORT DESCRIPTION OF THE DRAWINGS

DETAILED DESCRIPTION OF THE EMBODIMENTS OF THE INVENTION

Figure 1:
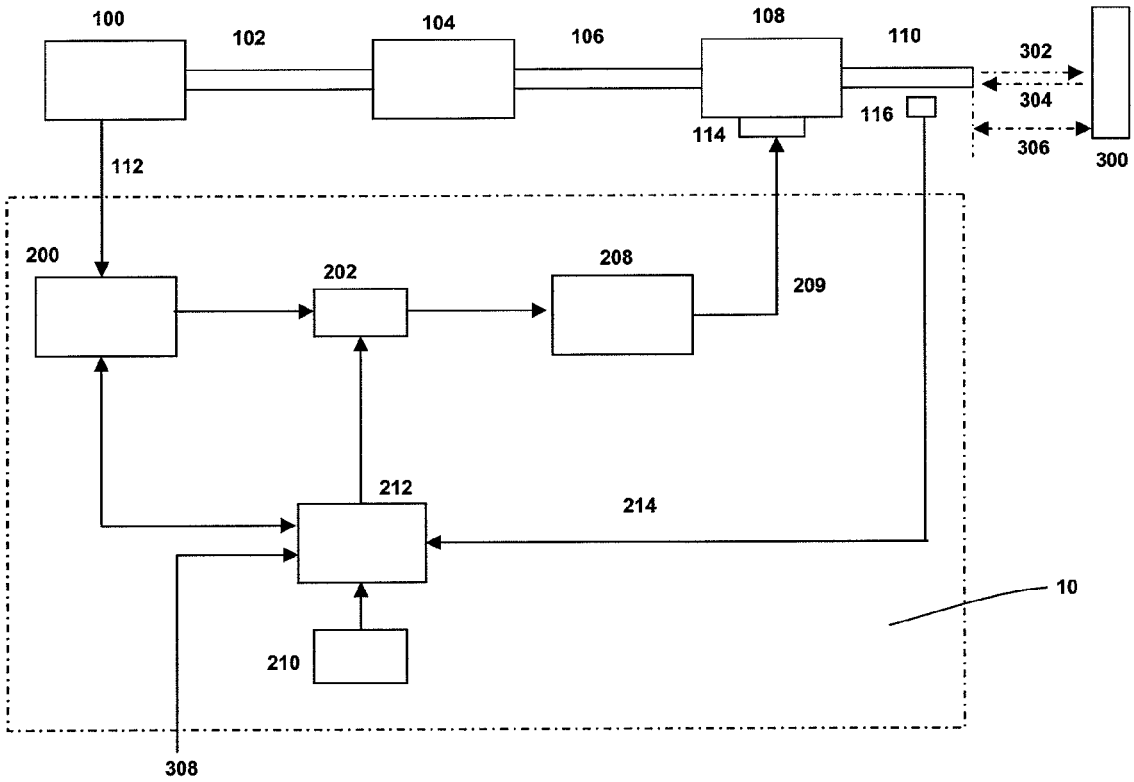
FIG. 1 shows the invention according to a first embodiment

FIG. 1 shows an active noise cancellation device 10 connected to a combustion engine 100 and to an exhaust gas channel. The combustion engine 100 is connected to an exhaust gas channel 102, 106 and 110. The exhaust gas channel includes a central muffler 104 and rear muffler 108. The combustion engine is connected over line 112 to the signal generator 200. The output of signal generator 200 is connected to a digital filter 202. The digital filter 202 also receives inputs from the calculation means 212.

An obstacle 300 near the exhaust gas channel 110 causes the sound 300 to reflect in the surroundings. The reflections are shown as 304.

The distance 306 between the obstacle and the exhaust gas channel, influences the sound reflections 304. A device which is not shown in the figure and which is external to the active noise control device, measures the distance 306 between the obstacle 300 and the exhaust gas channel 110. This distance 306 is delivered to the calculation means 212 as a distance value 308.

The calculation means 212 refers to the pre stored data records 210 in order to control the filter 202. The output of the digital filter 202 is given to an amplifier 208. The amplifier output is given to the sound converter 114 which is in close contact with the exhaust gas channel. The exhaust gas channel has a sound sensor 116 placed in it, output of sound sensor 116 is connected to the calculation means 212.

The combustion engine 100 mixes fuel and air in a cylinder, which is ignited, resulting in kinetic energy to move the vehicle. The residual from the combustion engine passes through the exhaust gas channel 102, 106 and 110. The exhaust gases cause noise in the exhaust gas channel. To some extent the mufflers 104 and 108 help in reducing the noise generated by the exhaust gases, but the additional noise reduction is done by the active noise cancellation device.

The active noise cancellation device typically operates by creating an anti noise signal which has same frequency as noise signal, is equal in amplitude and opposite in phase with noise signal which needs to be reduced. When the noise signal and the anti noise signal are acoustically combined, the two signals effectively cancel one another, significantly reducing the final sound, emitted into the surroundings of the exhaust gas channel.

Also the sound signal generated to reduce the noise signal, can be used to have a particular sound design in the surroundings.

The invention suggests a device which will reduce the noise in the exhaust gas channel of the combustion engine also taking into account the reflections of the sound caused by an obstacle near the exhaust gas channel 110.

In FIG. 1, the signal generator 200 receives the initial parameters like engine speed, engine load etc. from the combustion engine 100 over the connection 112. The major frequency component of the noise in the exhaust gas channel will be directly dependant on the engine speed. The noise in the exhaust gas channel is generated when the exhaust gases rush into the exhaust gas channel. The frequency of the exhaust gases rushing into exhaust gas channel is dependent on the revolutions of the crankshaft, number of cylinders and number of strokes used in the cylinders of the combustion engine.

The major component of the noise in the exhaust gas channel consists of the base frequency which is a function of engine parameters as explained above. But the noise signal will also have noticeable energy in the harmonics of the base frequency.

The amplitude of the noise signal is dependant on the load of the engine. Based on the initial parameters, the calculation means 212 computes the base frequency of the noise generated in the exhaust gas channel. The signal generator 200 generates the estimated base frequency and its harmonics and feeds them to the digital filter 202. The digital filter 202 is shown as a single block but may consist of plurality of filters to generate a set of frequencies. The parameters of the digital filter 202 are controlled by the calculation means 212 to generate the anti noise signal with appropriate amplitude and phase to reduce the noise in the exhaust gas channel. The output from the digital filter 202 is given to an amplifier 208. The output of the amplifier 208 is used to drive a sound converter 114 like loud speaker, which is placed in the exhaust gas channel. The outlet of the speaker enclosure and exhaust gas channel are positioned such that the acoustic coupling between the exhaust gas noise and anti noise signal, result in a significant reduction of the total exhaust noise level.

The static part of the noise reduction is done by estimating the base frequency using the engine speed and engine load parameters. Any correction required for the static part of the noise reduction is available in the pre stored data records. These data records are stored during the application phase of the engine test, during which the engine is tested under different conditions and the needed parameters are stored in the data records. The base frequency and its harmonics are generated with appropriate amplitude and phase and through the filter, amplifier and sound converter, the anti noise signal is finally mixed with the noise in the exhaust gas channel to reduce the noise.

The dynamic part of the noise reduction is done using the feedback loop from the sound sensor.

Any residual noise which remains in the exhaust gas channel 110 is received by a sound sensor 116. The sound sensor may be a microphone or any similar transducer. The sound sensor 116 produces an exhaust noise feedback signal which is transmitted back to the calculation means 212. The exhaust noise feedback signal represents residual error between the exhaust noise and the anti noise signal.

The calculation means 212 and the signal generator 200 will use the feedback signal along with the pre stored data records to fine tune the parameters of the digital filter 202 so that the resulting sound in the exhaust gas channel is at minimum level for the given conditions or for sound design.

The active noise cancellation explained above is a typical concept used in an automobile. The invention extends this concept further to handle sound reflections 304 caused by an obstacle 300 near the exhaust gas channel 110. The obstacle 300 may be a wall or another vehicle, typically encountered during parking of a vehicle. The obstacle 300 near the exhaust gas channel 110 causes in the sound sensor 116 an overlay of sound signals from the final muffler 108 and reflected sound 304. This will result in resonances and also amplification of some selected frequencies.

The influencing of the acoustic behaviour of the active noise cancellation device by the reflected sound 304 can lead to unwanted behaviour of the device, e.g., to an unstable behaviour with the production of disturbing sound signals.

To overcome this problem a correction needs to be applied for the anti noise signal generated to cancel the noise in the exhaust gas channel. The correction depends upon the distance 306 between the obstacle 300 and the exhaust gas channel 110. The distance 306 is measured by a distance measuring device which is not shown in the figure and which is external to the active noise cancellation device.

Distance measuring devices at the rear of the vehicle, are a state of the art. These distance measuring devices use a transmitter and a receiver. The transmitter transmits a signal and the receiver receives the signal reflected by an obstacle. The time difference between transmission and reception of the signal is processed and the distance between the transmitter and the obstacle is computed. The distance measuring devices in the vehicles do the distance measurements in real time and inform the user through audio or visual indicators about the obstacles near the rear of the vehicle. This information will be useful especially during parking of the vehicle.

Different distance measuring devices may use different techniques for measurements like ultrasonic sensors, radar sensors or lasers etc.

The invention proposes that the active noise cancellation device 10 receives one or more distance values 308 from the distance measuring device.

The calculation means receives the distance values 308. As a function of the distance values 308 the anti noise signal is either made in-active or a suitable correction is applied to the anti noise signal which is used to influence the noise in the exhaust gas channel. The correction values are determined for different distance values 308 during the application phase of the engine and stored as part of the pre-stored data records 210.

For the determination of pre-stored data, a test engine of type of the later engine is used. Beside fabrication tolerances, test engine will have similar characteristics as that of the actual engine in the vehicle.

The active noise cancellation device 10 is housed in a casing with input connection 112 for connection with engine, input connection 214 from sound sensor, input connection 308 for connection with a distance measuring device, an output connection 209 for sound converter and other required wiring for power supply.

The digital filter is shown in the FIG. 1 as separate element as an example. But the digital filter can also be built into the signal generator.

Figure 2:
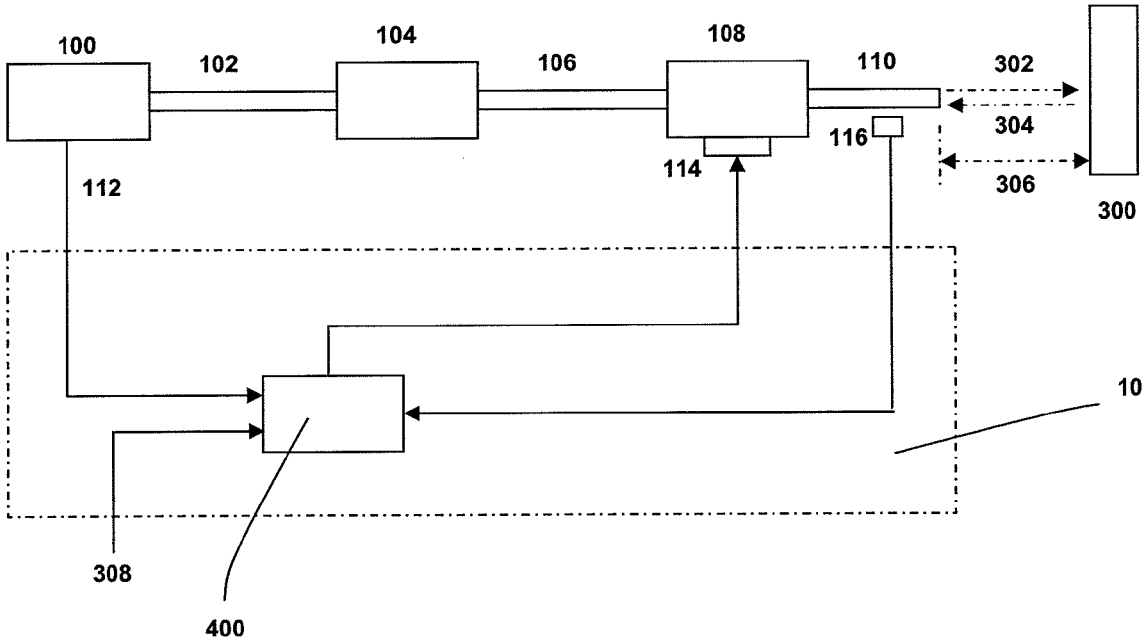
FIG. 2 shows the invention according to a first embodiment

FIG. 2 shows another embodiment of the invention. Here 100, 102, 104, 106, 108, 110, 112 and 114 are same elements as shown in FIG. 1 and have the same functionality. The electronic device used for active noise cancellation is integrated into the existing engine control unit 400.

The electronic control unit 400 does the complete control and monitoring of the vehicle engine. The functionality of active noise cancellation is made part of the engine control unit 400 by integrating the signal generator, filters, amplifier, calculation means and data records as a single unit.

The invention claimed is:

1. A device for active noise cancellation in an exhaust gas channel of a combustion engine, comprising:

means for receiving a sound signal from the exhaust gas channel;

means for generating a frequency signal to influence the sound generated in the exhaust gas channel;

calculation means for receiving the sound signal and generating control signals to influence amplitude and phase of the frequency signal;

wherein said device receives information about a distance of the exhaust gas channel from an obstacle and uses said information to modify the frequency signal.

2. The device of claim 1, wherein the information about the distance of the exhaust gas channel from an obstacle is provided by a device that is external to the active noise cancellation device.

3. The device of claim 1, wherein the means for generating the frequency signal receives a speed signal of the combustion engine and derives a first frequency signal dependant of the speed signal.

4. The device of claim 1, wherein the means for generating the frequency signal further generates harmonics of a first frequency of the frequency signal.

5. The device of claim 1, wherein the calculation means uses pre-stored data records giving a dependency between an engine speed, an engine load, and the phase and amplitude of the frequency signal.

6. The device of claim 1, wherein the calculation means uses pre-stored data records giving a dependency between the frequency signal and the distance of the exhaust gas channel from the obstacle.

7. The device of claim 1, wherein the calculation means receives a feedback signal from a sound sensor and derives the control signals for a signal generator and filters.

8. The device of claim 5, wherein the pre-stored data records are derived during an application phase wherein the engine is tested under different conditions and the data records are stored.

9. A method of operating an active noise cancellation device to cancel noise in an exhaust gas channel of a combustion engine, the method comprising:

receiving a sound signal from the exhaust gas channel through a sound sensor;

based on the received sound signal, generating control signals for a signal generator and digital filters to influence amplitude and phase of a frequency signal;

receiving information about a distance of the exhaust gas channel from an obstacle;

modifying the frequency signal using pre-stored data records of a dependency between the frequency signal and the distance of exhaust gas channel from the obstacle; and acoustically coupling the frequency signal with the sound generated in the exhaust gas channel using a sound converter to influence the sound generated in the exhaust gas channel.

* * * * *